US007909042B2

(12) United States Patent
Bachrach et al.

(10) Patent No.: US 7,909,042 B2
(45) Date of Patent: Mar. 22, 2011

(54) LICE AND NIT REMOVAL COMB WITH SQUARE SHAPED METAL TEETH

(76) Inventors: Daniel Bachrach, Great Neck, NY (US); Frank B. Bachrach, Great Neck, NY (US)

( * ) Notice: Subject to any disclaimer, the term of this patent is extended or adjusted under 35 U.S.C. 154(b) by 0 days.

(21) Appl. No.: 12/655,661

(22) Filed: Jan. 5, 2010

(65) Prior Publication Data

US 2010/0300469 A1 Dec. 2, 2010

Related U.S. Application Data

(60) Provisional application No. 61/216,862, filed on May 26, 2009.

(51) Int. Cl.
*A45D 24/00* (2006.01)

(52) U.S. Cl. ..... 132/159

(58) Field of Classification Search ..... 132/219, 132/120, 121, 159
See application file for complete search history.

(56) References Cited

U.S. PATENT DOCUMENTS

| | | | | |
|---|---|---|---|---|
| 4,187,866 | A * | 2/1980 | Zwiren et al. | 132/151 |
| 4,612,944 | A | 9/1986 | Bachrach et al. | 132/11 |
| 4,763,675 | A | 8/1988 | DeFelice | 132/137 |
| 5,636,646 | A | 6/1997 | Zito | 132/149 |
| 5,873,374 | A | 2/1999 | Sanz | 132/125 |
| 5,927,291 | A | 7/1999 | Beall | 132/144 |
| 6,158,443 | A * | 12/2000 | Leman et al. | 132/120 |
| 6,691,713 | B1 | 2/2004 | Altschuler | 132/200 |
| 7,089,945 | B1 | 8/2006 | Barge | 132/129 |
| 7,117,873 | B2 | 10/2006 | Bachrach et al. | 132/148 |

* cited by examiner

*Primary Examiner* — Rachel R Steitz
(74) *Attorney, Agent, or Firm* — Watov & Kipnes, P.C.; Kenneth Watov

(57) ABSTRACT

A metal-toothed comb is provided having elongated identical teeth each with a square cross-section along substantially the entire length, elongated edges of each tooth being slightly rounded, free ends of each of the teeth being slightly rounded, whereby the teeth are successively positioned juxtaposed in a common plane, with elongated edges of each tooth opposing one another, and the distance between the teeth being a constant 0.004 inch along the entire length of the gap therebetween, except for a relatively small portion proximate the distal ends of each tooth, which are tapered down to a rounded tip.

19 Claims, 6 Drawing Sheets

LICE AND NIT REMOVAL COMB WITH SQUARE SHAPED METAL TEETH

RELATED APPLICATION

The present invention is related to Provisional Application No. 61/216,862, filed on May 26, 2009, and takes priority therefrom to the extent that there is no conflict therewith.

FIELD OF THE INVENTION

The present invention is related generally to products such as combs for personal grooming of the hair, and more particularly to combs for removing lice and nits from the hair and scalp of an infected individual.

BACKGROUND OF THE INVENTION

Head lice (*Pediculus humanus capitis*) are small parasitic insects, which have evolved to live and thrive on the scalp and neck hairs of their human host. The external parasitic insects are often difficult to eradicate, and present a health problem to those afflicted. Head lice can also afflict people in developed areas such as in schools where people are in constant close contact. Those afflicted with head lice have to undergo some form of treatment or intervention for relief. The insecticide or pesticide is usually periodically applied to the hair and scalp of the afflicted individual to kill the head lice. Recently, it has been found that certain head lice strains have developed resistance against some of the more popular insecticides or pesticides currently available in the market.

In addition to insecticides or pesticides, mechanical means have also been employed in the treatment of head lice. Such mechanical means function by physically removing head lice and nits from the hair and scalp and can be effectively implemented alone or in combination with the insecticide or pesticide treatment. One mechanical means found to be effective is the lice and nit comb, which is a toothed instrument adapted for confining hair and sifting out the lice and nits. The typical lice and nit comb includes a plurality of spaced apart teeth arranged in a single row. The space between adjacent teeth is typically diminutive to permit the strands of hair to pass through as the comb is drawn, but prevent head lice and nits from passing through the space. In this manner, lice and nits present on the hair strands are effectively scraped off as the comb moves along the length of the hair.

Ideally, in order to ensure that the lice and nits are caught by the comb, the entire outer surface of the hair strands are scraped and cleaned to prevent the lice and nits from avoiding the scraping action. However, the adjacent parallel teeth of known plastic lice and nit combs have teeth of limited length, whereby the teeth are only able to scrape portions of the limited number of hair strands occupied therebetween. These limitations have made prior art lice and nit combs more time consuming and inconvenient to use, and less effective in sifting and removing lice and nits from hair.

Accordingly, there is a need for an improved lice and nit removal comb capable of captively and circumferentially grasping around a relatively large number of strands of hair for enhanced scraping and cleaning action to entrap and remove lice and nits present as the device is drawn along the length of the grasped hair. In this manner, any lice and/or nit present in the hair is efficiently and effectively sifted and removed therefrom with minimized effort.

SUMMARY OF THE INVENTION

One object of the present invention is to provide a lice and nit removal comb that has rigid elongated teeth which resist bending upon use.

Another object of the invention is to provide a lice and nit removal comb that includes elongated teeth capable of removing lice and nits along substantially the entire length of the teeth in the spaces between successive juxtaposed teeth lying in a common plane.

With these and other objects in mind, the present invention includes a handle portion for permitting a user to grasp the comb, another portion for mounting rigid bend resistant metal teeth at their proximal ends in a manner for insuring that all portions of each tooth are parallel to an adjacent tooth, whereby except for the free ends of each tooth, each have a square-shaped cross-section. Each tooth, proximate their distal end portions tapers slightly to a rounded tip for preventing injury to the scalp of a user. The longitudinal corner edges of each tooth have a small radius, whereby between the successive pairs of parallel teeth, the longitudinal edges oppose one another for almost the entire length of each tooth, except for the extreme distal end portion which tapers to a rounded end. In the preferred embodiment of the invention, the space between opposing corner edges of each pair of adjacent teeth is 0.004 inch from the proximal end to their tapered distal end portions. Proximal end portions of each tooth are formed in a notched configuration for enhancing the securement of each tooth in the tooth retaining portion of the comb. A comb handle and the tooth retaining portions are preferably formed from a single piece of plastic material.

BRIEF DESCRIPTION OF THE DRAWINGS

Various embodiments of the present invention are described in detail below with reference to the drawings, in which like items are identified by the same reference designation, wherein.

DETAILED DESCRIPTION OF THE INVENTION

Figure 1A:
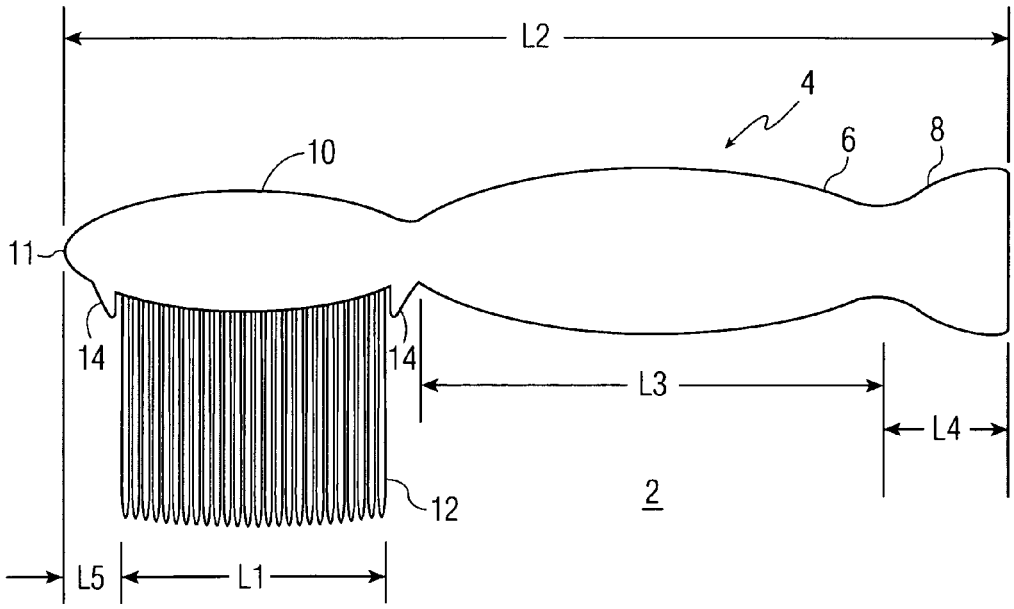
FIG. 1A is a side view of the present comb for one embodiment of the invention having a scalloped handle portion.
Figure 1B:
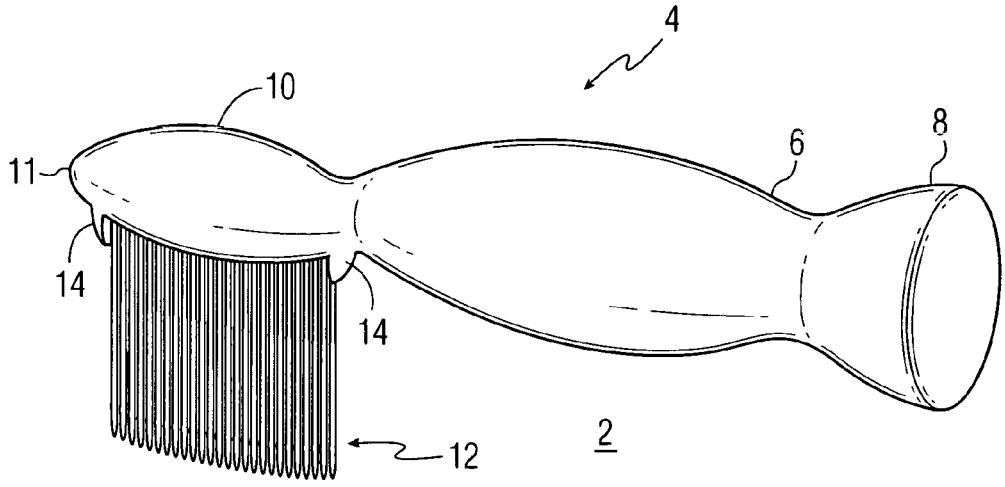
FIG. 1B is a pictorial view of the embodiment of FIG. 1 looking from the back end of the handle at an angle.

With reference to FIG. 1A, in one embodiment of the invention, the present comb 2 includes a scalloped-shaped frame or body 4 having a hand-gripping portion 6, a tail portion 8, and a front tooth holding portion 10 for rigidly maintaining the teeth 12, a rounded front tip 11, and downwardly protruding tabs 14, as shown. The various dimensions shown, namely, L1 through L5 are typically a matter of choice and can be varied. In this example, 26 teeth are shown, and L1 is about 1.563 inches for 26 teeth 12. L2 is about 5.500 inches, L3 about 2.750 inches, L4 about 0.625 inch, and L5 about 0.375 inch. As indicated, these dimensions are approximate, and are provided for purposes of illustration. In FIG. 1B, a pictorial is shown of the inventive comb of FIG. 1A looking at an angle from the back of the tail portion 8.

Figure 2:
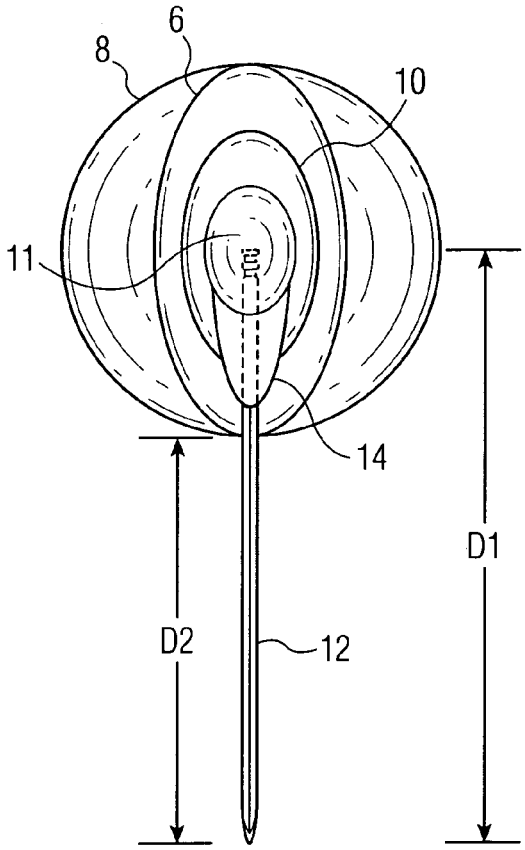
FIG. 2 is a front elevational view of the comb of FIG. 1.

With reference to FIG. 2, the length of each tooth 12, shown as D1, can range from 1.500 inches to 2.720 inches. In the preferred embodiment, the length D1 of each of the teeth 12 is 1.897 inches. Also, in this example, the minimum length of the teeth 12 protruding from the one portion 10, shown as D2 can range from about 1.250 inches to 1.500 inches. In the preferred embodiment, D2 is 1.425 inches.

Figure 3:
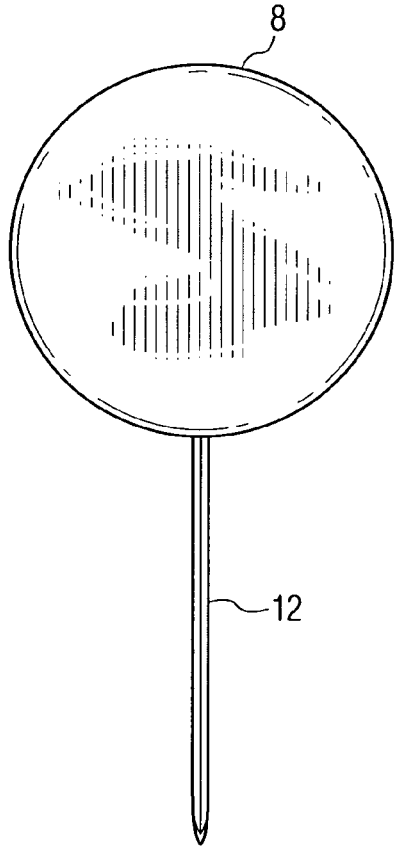
FIG. 3 is a back elevational view of the comb of FIG. 1.

FIG. 2 is a front elevational view of the comb 2. As shown, in this example, the handle or hand-gripping portion 6 is oval, as is front portion 10. The tail portion 8 has a circular transverse cross section (see FIG. 3).

Figure 4:
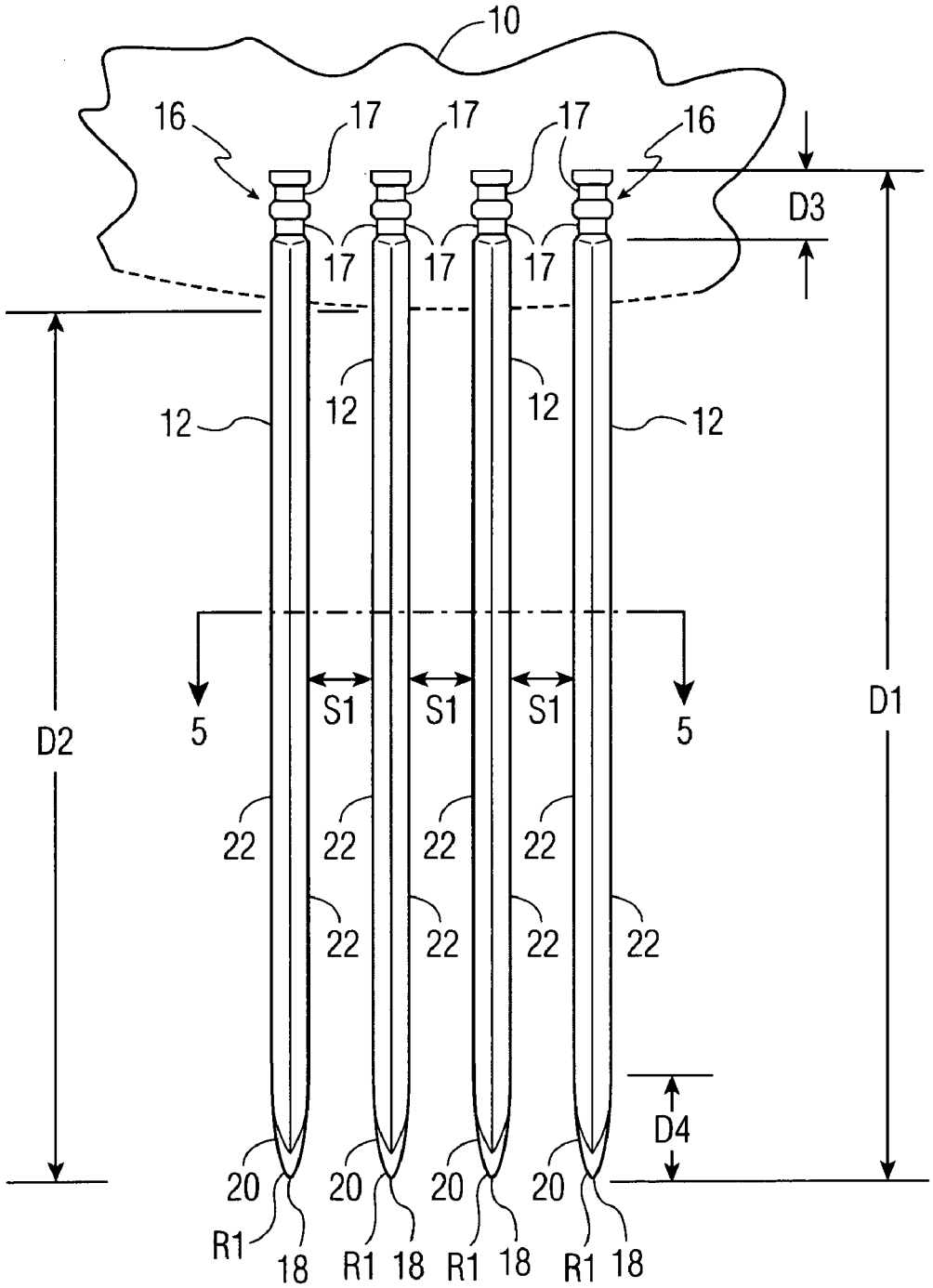
FIG. 4 is an enlarged cutaway view of the tooth mounting portion of the comb of FIG. 1 showing the arrangement of the proximal ends of the teeth secured therein.

With reference to FIG. 4, an enlarged view of four of the centermost located teeth 12 are shown as mounted in the front portion 10 of the comb 2. As shown, proximal ends 16 of the teeth 12 include notches 17 to enhance the retention of these ends in the plastic material of the comb body 4, in this example. In this regard, the comb body 4 can be provided by any suitable plastic material, such as ABS plastic, or polypropylene, for example. The dimension D3 for the notched end portion 16 can range between 0.15 inch to 0.25 inch, and in the preferred embodiment is 0.1875 inch. The portion of the teeth 12 proximate to the distal end portion taper slightly converging to a rounded end 18. The taper is preferably 1:5, but can be extended to 1:8. The tapered distal end portion 20 has a length D4 ranging from 0.093 inch to 0.156 inch, whereby the preferred length D4 is 0.275 inch, in this example. The free ends 18 of each tooth 12 have a preferred radius R1 of about 0.013 inch, in this example, but R1 can be extended to 0.16 inch.

Figure 5:
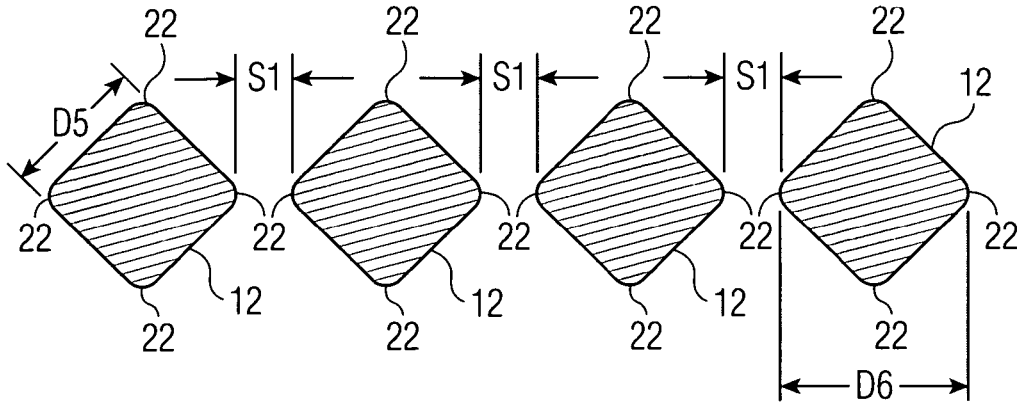
FIG. 5 shows a cross-sectional view of the teeth of FIG. 4 taken along 5-5 thereof.

In FIG. 5, a cross-section taken along 5-5 of FIG. 4 of the teeth 12 is shown. As shown, the teeth 12 have a square cross-section for almost their entire lengths. The dimension D5 for the sides of each tooth 12 is 0.039 inch, and the diameter D6 of 0.052 inch, in the preferred embodiment of the invention. Also, D5 can range 0.032 inch to 0.042 inch, and D6 can range from 0.045 inch to 0.060 inch. With regard to the use of a square cross-sectional shape for the teeth 12, the present inventors determined that the square shape provides the greatest rigidity and strength to the teeth 12, for avoiding bending thereof during use. In this manner, through use of metal teeth 12, it was further determined that longer teeth 12 can be utilized than obtainable with plastic. Long plastic teeth greater than 0.625 inch in length tend to bend during use, rendering them prone to break, and ineffective in comparison to much longer metal teeth. It was also determined that a diamond-shape for the cross section of the teeth 12 is less preferred from both a strength and rigidity standpoint. It was further determined through experimentation that the longitudinal edges or corner edges 22 of each tooth 12 should be slightly rounded, preferably with a radius R2 of about 0.005 inch. Through use of the rounded edges 22, it was determined that hairs would more easily be passed through the gap S1 between the teeth, along with a greatly reduced chance of cutting hairs, while maintaining the gap S1 at its preferred dimension of 0.004 inch to trap any lice or nits along almost the entire lengths of the teeth 12 during use. It should be noted that the nits or lice eggs have a length of about 0.028 inch to 0.04 inch, and a width of 0.012 inch to 0.020 inch. The hatched insect or head lice typically have a length of about 0.039 inch to 0.051 inch. The gap or spacing S1 between opposing edges 22 of the teeth 12 can range between 0.0035 inch to 0.0045 inch. The preferred gap S1 of 0.004 inch between the teeth 12 will permit opposing edges 22 thereof to capture the eggs and head lice by scrapping them off the hairs and entrapping them between the teeth 12. It was further determined that stainless steel is the preferred material for the teeth 12. The inventors further determine that through the use of metal teeth 12, the teeth will remain substantially more rigid than plastic teeth, and have less tendency to flex or break. Through use of a square cross section in combination with the metal teeth 12, the inventors determined that the teeth 12 have the strength to resist any movement during use, thereby avoiding catching hairs and pulling hairs out of the user. As previously mentioned, through use of long metal teeth 12, more hairs can be wiped, when compared to combs using relatively shorter plastic teeth.

Figure 6:
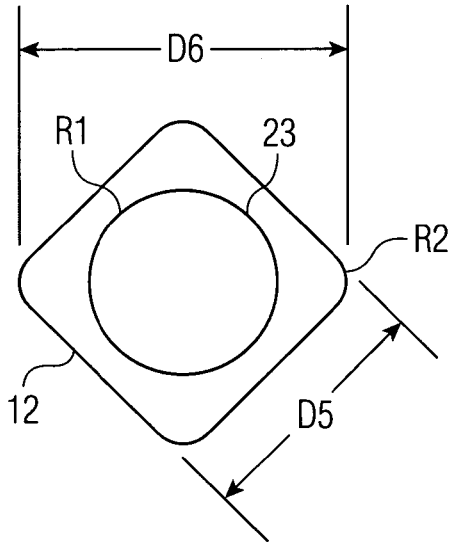
FIG. 6 shows a bottom view of the distal ends or free ends of each tooth.

FIG. 6 shows a bottom plan view of the distal ends of the teeth 12. As shown, the free or distal ends 23 are rounded with a radius R1 of 0.013 inch, for the preferred embodiment. As previously mentioned, R1 can be extended to 0.016 inch. D5 and D6 dimensions are given above.

Figure 7:
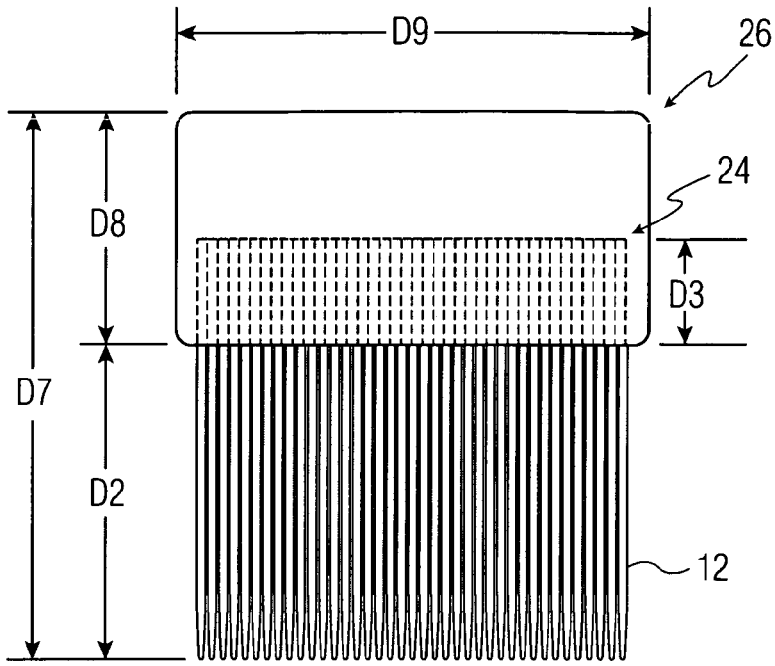
FIG. 7 shows a front elevational view of an alternative embodiment of the invention using a different handle configuration.
Figure 8:
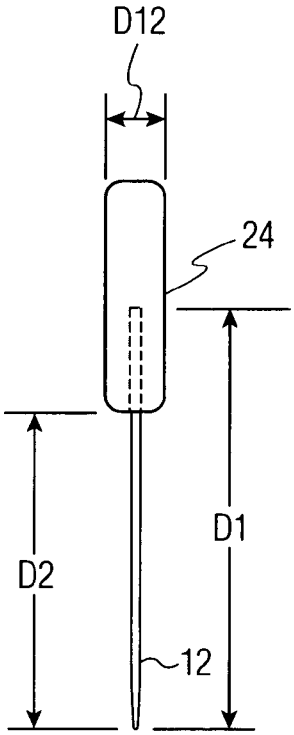
FIG. 8 shows a right-side elevational view of the embodiment of the invention of FIG. 7, the left-side elevational view being identical thereto.

FIG. 7 shows an alternative embodiment of the invention that includes a differently shaped handle 24. As with the previous embodiment, the teeth 12 are in the same plane, and are configured as previously described. The length D1 of each tooth 12 remains in the preferred embodiment at 1.897 inches, and the exposed length of each tooth 12 shown as D2 is 1.425 inches. In this example, the total length of the alternative comb embodiment 26 shown as D7 is 2.462 inches, with the width of alternative handle 24 D8 being in the preferred embodiment 1.037 inches. The length D9 of the alternative comb 26 is in the preferred embodiment 2.122 inches. As shown in FIG. 8, the thickness D12 of the handle 24 is 0.25 inch in the preferred embodiment.

Figure 9A:
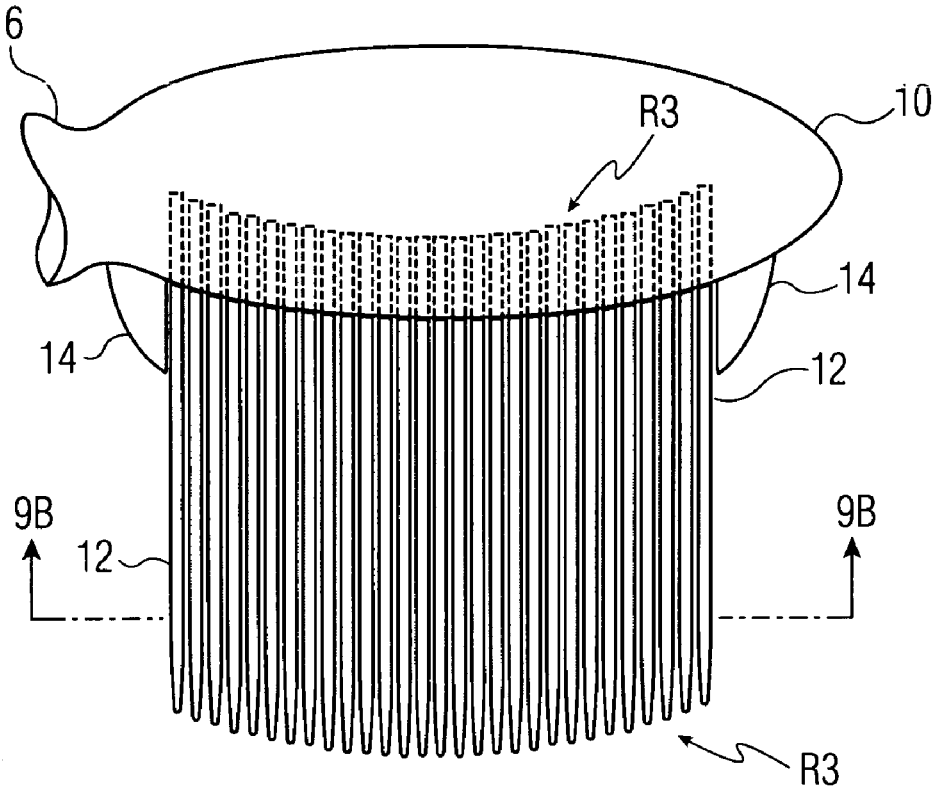
FIG. 9A shows an alternative embodiment to that of FIGS. 1A, 1B, and 2, wherein in this alternative the distal ends of the teeth are arranged in a curved or concave configuration.
Figure 9B:
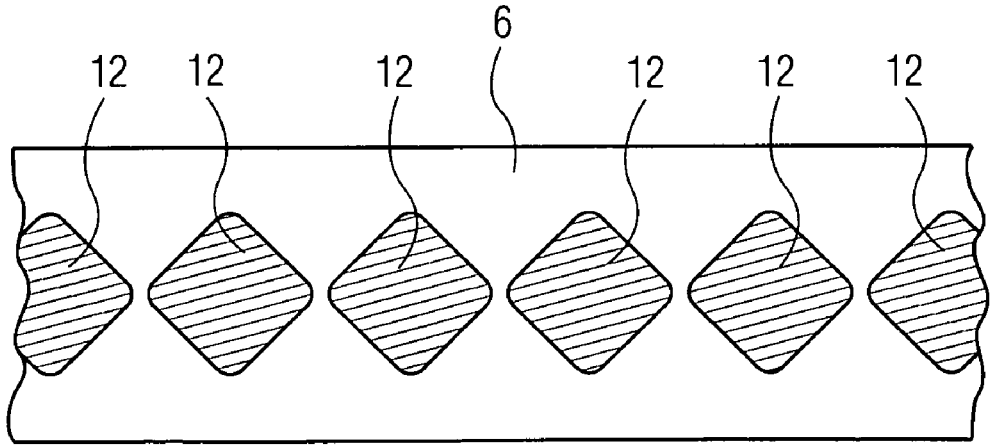
FIG. 9B is a partial cross sectional view taken along 9B-9B of FIG. 9A.

As shown in FIG. 9A for another embodiment of the invention, the teeth 12 are arranged in a convex configuration, that is form a curved configuration like the exterior of a circle. The radius R3 in the preferred embodiment is 2.1457 inches. FIG. 9B is a cross section taken along 9B-9B of FIG. 9A, and would coincidentally appear the same for other embodiments of the invention Through experimentation the inventors developed a process for manufacturing the teeth 12. More specifically, stainless steel wire is pulled through cutters for producing a square shape to the wire. The square-shaped wire is then cut into the required lengths for the teeth 12. The distal tips of the teeth 12 are then radiused to produce the rounded ends 18 of the teeth 12. The proximal ends 16 are machined to form the notches 16. The teeth 12 are then loaded into an insert that is placed into a mold for molding appropriate plastic material about the teeth 12, to form the completed comb 2 or 24. The mold is configured to hold the teeth 12 in proper alignment during the molding process.

Although various embodiments of the invention have been shown and described, they are not meant to be limiting. Those of skill in the art may recognize certain modifications to these embodiments, which modifications are meant to be covered by the spirit and scope of the appended claims. For example, the teeth 12 can be provided with a rough texturing in order to further enhance their scrapping action in removing lice and nits.

What is claimed is:

1. A lice and nit removal comb comprising:

a body having a first portion for hand-gripping, and a second portion adapted for rigidly retaining teeth;

a plurality of elongated metal teeth each having a free end and a proximal end portion configured for enhancing the rigid retention thereof in said second portion of said body, each having a square cross section between proximal and distal end portions forming four longitudinal side edges, each having an equal total length ranging from 1.5 inches to 2.72 inches, the length of said teeth protruding from said second portion of said body ranging from 1.25 inches to 1.50 inches, the distal end portion of each of said teeth having a taper ranging from 1:5 to 1:8, the free ends of each of said teeth being rounded, said teeth being juxtaposed to one another with opposing side edges in parallel, and the opposing side edges of said teeth being rounded and having a constant space therebetween in the range of 0.0035 inch to 0.0045 inch in the distance between proximal and distal end portions, respectively.

2. The comb of claim 1, wherein said proximal end portion of each of said teeth is notched for a distance ranging from 0.15 inch to 0.25 inch.

3. The comb of claim 1, wherein said proximal end portion of each of said teeth is notched for a distance of 0.1875 inch.

4. The comb of Claim 1, wherein the rounded opposing side edges of each of said teeth have a radius of 0.005 inch.

5. The comb of claim 1, further comprising a transverse distance for the sides of each of said teeth ranging from 0.032 inch to 0.042 inch.

6. The comb of claim 1, wherein the transverse distance from the sides of each of said teeth is 0.039 inch.

7. The comb of claim 1, wherein the tapered distal end portion of each of said teeth is 0.275 inch from the free ends thereof.

8. The comb of claim 1, wherein the tapered distal end portion of each of said teeth ranges 0.093 inch to 0.156 from the free ends thereof.

9. The comb of claim 1, wherein the free ends of each of said teeth have a radius ranging from 0.013 inch to 0.016 inch.

10. The comb of claim 1, wherein the free ends of each of said teeth have a radius of 0.013 inch.

11. The comb of claim 1, wherein said plurality of elongated metal teeth each consist of stainless steel.

12. The comb of claim 1, wherein the opposing side edges of the juxtaposed ones of said teeth are spaced therebetween 0.004 inch in the distance between proximal and distal end portions thereof.

13. The comb of claim 1, wherein said proximal end portions of each of said teeth are notched for a distance of 0.1875 inch.

14. The comb of claim 1, wherein the free ends of said plurality of elongated metal teeth, respectively, lie in the same plane, thereby forming a straight line.

15. The comb of claim 1, wherein the free ends of said plurality of elongated metal teeth are arranged in a convex configuration.

16. The comb of claim 15, wherein the radius of curvature for the convex configuration of the free ends of said teeth is 2.1457 inches.

17. The comb of claim 1, wherein said body is formed from a single piece of plastic material, the material of the second portion of said body captively surrounding proximal end portions of said plurality of elongated metal teeth.

18. The comb of claim 1, wherein said plastic material is selected from the group consisting of ABS plastic, and polypropylene.

19. A lice and nit removal comb comprising:

a body having a first portion for hand-gripping, and a second portion adapted for rigidly retaining teeth;

a plurality of elongated metal teeth each having a free end and a square cross section between proximal and distal end portions, said teeth being juxtaposed with longitudinal edge portions opposing one another, the distance between the opposing longitudinal edge portions being constant between respective proximal end and distal end portions, the distance being small enough to effectively have the edge portions of said teeth scrape off and retain lice and nits from hair passed through said teeth, both the edge portions of said teeth and the free ends thereof being rounded, and extreme distal end portions of said teeth being tapered.

* * * * *

UNITED STATES PATENT AND TRADEMARK OFFICE

CERTIFICATE OF CORRECTION

PATENT NO. : 7,909,042 B2
APPLICATION NO. : 12/655661
DATED : March 22, 2011
INVENTOR(S) : Daniel Bachrach and Frank B. Bachrach It is certified that error appears in the above-identified patent and that said Letters Patent is hereby corrected as shown below:

In column 5, line 26, claim 6, please replace "1," with --5,--;

In column 6, line 5, claim 13, please replace "1," with --6,--; and

In column 6, line 21, claim 18, please replace "1," with --17,--.

Signed and Sealed this
Twenty-sixth Day of June, 2012

David J. Kappos

David J. Kappos
*Director of the United States Patent and Trademark Office*